US006130647A

United States Patent [19]

Zürcher et al.

[11] Patent Number: 6,130,647

[45] Date of Patent: Oct. 10, 2000

[54] SLOT ANTENNA IN PARTICULAR FOR A TIMEPIECE

[75] Inventors: Jean-François Zürcher, Tavel/Clarens; Olivier Staub, Lausanne; Anja Skrivervik, Champvent, all of Switzerland

[73] Assignee: Asulab S.A., Bienne, Switzerland

[21] Appl. No.: 09/296,134

[22] Filed: Apr. 22, 1999

[30] Foreign Application Priority Data

Apr. 28, 1998 [EP] European Pat. Off. ..... 98107713

[51] Int. Cl.[7] ..... H01Q 13/10

[52] U.S. Cl. ..... 343/767; 343/718

[58] Field of Search ..... 343/718, 767, 343/769, 700 MS; H01Q 13/10, 1/24

[56] References Cited

U.S. PATENT DOCUMENTS

| | | | |
|---|---|---|---|
| 4,063,246 | 12/1977 | Greiser | 343/769 |
| 5,353,038 | 10/1994 | Osborne et al. | 343/708 |
| 5,442,367 | 8/1995 | Naito et al. | 343/700 MS |
| 5,465,098 | 11/1995 | Fujisawa et al. | 343/718 |
| 5,589,840 | 12/1996 | Fujisawa | 343/718 |

FOREIGN PATENT DOCUMENTS

| | | |
|---|---|---|
| 0 565 725 A1 | 10/1993 | European Pat. Off. . |
| 0 643 437 A1 | 3/1995 | European Pat. Off. . |
| 0 766 152 A1 | 4/1997 | European Pat. Off. . |
| 2 304 465 | 3/1997 | United Kingdom . |

OTHER PUBLICATIONS

Patent Abstracts of Japan. vol. 9, No. 288 (E–358), Nov. 15, 1985 & JP 60 127803 A (Shigeo Matsumura), Jul. 8, 1985, Abstract.

*Primary Examiner*—Tan Ho
*Attorney, Agent, or Firm*—Griffin & Szipl, P.C.

[57] ABSTRACT

A slot antenna (21) is arranged to be connected to an asymmetrical output (29) of an antenna circuit (25). The antenna comprises a dielectric substrate (23), and a printed circuit conducting element (22; 22') attached to the substrate and defining a radiating slot (24; 24') of the antenna and having parallel edges. The antenna is characterized in that it further comprises a printed central line (27; 27') arranged in the slot (24; 2440 ) and allowing the direct connection of the output (29) in such a manner that this central line (27; 27') realizes the transition between the output and the antenna.

7 Claims, 1 Drawing Sheet

SLOT ANTENNA IN PARTICULAR FOR A TIMEPIECE

The present invention concerns a slot antenna intended to be connected to an asymmetrical output of an antenna circuit, and more specifically, the adaptation and the excitation of such slot antenna in horological applications. However, it should be understood that the invention is not limited to these applications.

BACKGROUND OF THE INVENTION

This type of antenna comprises a conducting element arranged on the dielectric substrate and defining a slot having parallel edges. Such an antenna is already described in the document EP 0 766 152 in the name of the present applicant. FIG. 1 shows the antenna described in this document. This slot antenna 11 consists of a printed circuit conducting element 12 attached to a dielectric substrate 13. This substrate is preferably of a flexible material to allow the arrangement of this antenna in an assembly groove of a horologic case in such a way that the antenna may be rolled around this case. A radiating slot 14 is formed in the conducting element. This antenna is connected to an antenna circuit comprising a micro receiver-emitter 15 which is located in the horologic case. The connection between the antenna 11 and the micro receiver-emitter 15 is carried out at two excitation points 16 and 17, normally by a transmission line such as a coaxial cable. This coaxial cable may be considered as the output of the antenna circuit. As the output of the antenna circuit is asymmetrical, it is necessary to adapt the symmetric antenna to this output. Thus, a conversion device is necessary which is mounted between the symmetrical antenna and the asymmetrical output. Such a device is known to the skilled person by the term "balun" (for balanced-to-unbalanced). This "balun" is generally obtained by using discrete elements, such as a condensator and/or a certain length of the line. In the above-mentioned document, the transmission line 18 connected an excitation point 16 via an adaptation condensator C (see FIG. 1) to micro receiver-emitter 15 of the antenna circuit, and the other excitation point 17 is connected to the mass. The value of the condensator naturally depends on the used frequency, but may be around several pico-farads for the applications described in this document. It may thus be understood that such a "balun" is not very practical, is large in size and is expensive.

However, for aesthetic reasons, and because of the size and price etc., (criteria which are particularly important in horological technology), solutions are searched for allowing to reduce cost and to simplify the assembly, the excitation, as well as the adaptation of such an antenna.

SUMMARY OF THE INVENTION

Thus, the invention has an object to provide a slot antenna which avoids the use of discrete components for the excitation and the adaptation by proposing a slot antenna having an integrated excitation, which serves at the same time as a "balun" obtaining the transition between the output of the micro receiver-emitter and the antenna.

The invention has thus as object a slot antenna according to claim 1.

Thanks to those features, an antenna structure is obtained, which is optimised for the excitation in a timepiece. Furthermore, this antenna allows to obtain a gain/bandwidth ratio which is at least equal to that of known antennas, but with a large simplification, thereby saving space and suppressing components while at the same time being cheaper to manufacture.

BRIEF DESCRIPTION OF THE DRAWINGS

Other features and advantages of the invention will become more clearly when reading the following description which is given solely by way of a non-limitative example and in which reference is made to the annexed drawings in which.

DETAILED DESCRIPTION OF THE INVENTION

Figure 1:
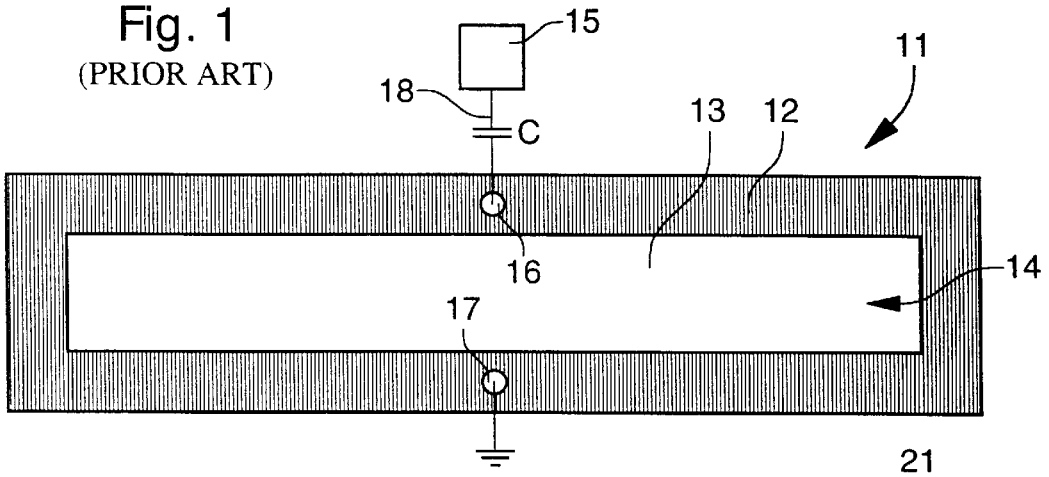
Fig. 1 (PRIOR ART)
FIG. 1 already described is a prior art slot antenna.
Figure 2:
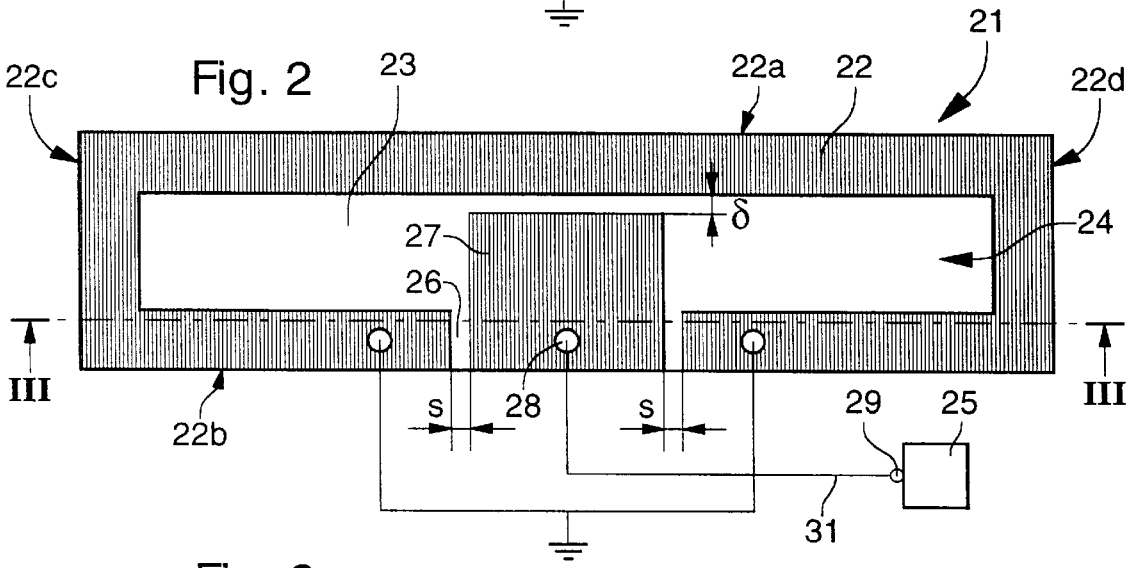
FIG. 2 is a top view of a first embodiment of a slot antenna according to the invention.
Figure 3:
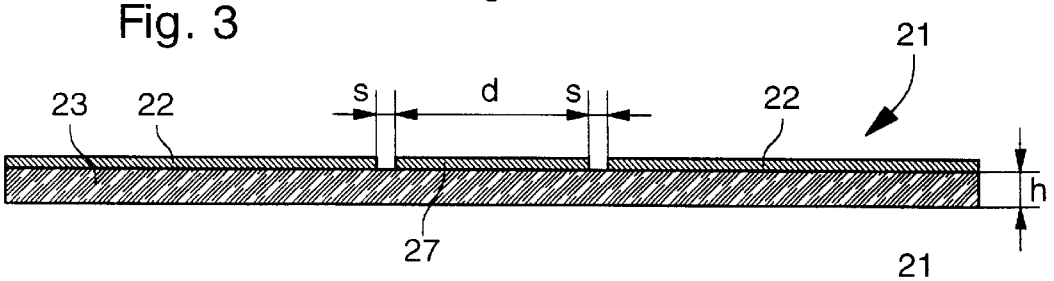
FIG. 3, is a cross-sectional view of the antenna of FIG. 2.

FIGS. 2 and 3 represent the first embodiment of a slot antenna according to the invention which is suitable for a timepiece. The general stucture of the antenna according to the invention is similar to that of the antenna of the above-mentioned document EP 0 766 152. Thus, a slot antenna 21 is shown which consists of a printed circuit conducting element 22, for example made of copper, fixed to a dielectric substrate 23. This substrate is preferably of a thin flexible material, for example of perstorp epoxy or of kapton, allowing to place this antenna in an assembly groove of a case of a timepiece in such a way that the antenna may be rolled around this case, as that is explained in more detail in the above-mentioned document. Preferably, this substrate 23 has a thickness which is around 0.1 mm.

The conducting element 22 has a rectangular shape and defines a radiating slot 24 having parallel edges. In fact, the conducting element 22 has, in this example, two long parallel edges 22*a* and 22*b*, and two short parallel edges 22*c*, 22*d*. Slot 24 is thus also of a rectangular shape.

In this embodiment, it can be seen that conducting element 22 does not completely close slot 24, but leaves a central opening 26 in one of the long edges 22*b*. Of course, the other long edge 22*a* may be left open instead of this edge 22*b*.

This antenna further comprises a central printed line 27 which is placed in slot 24 at opening 26. This central line 27 is of the same material and is fixed to substrate 22 in the same way as conducting element 22. In this example, central line 27 has a rectangular shape having a width "d", but such a shape is not mandatory. The inferior side of the central line is aligned with the long edge 22*b* and the top side enters into the slot and approaches the outer long edge 22*a*. However, the central line does not touch this edge 22*a*, but is removed therefrom by a distance δ. The central line 27 is also removed by a distance s from each of the two extremities of the long edge 22*b* of conducting element 22.

Antenna 21 is connected to an output 29 of an antenna circuit comprising a micro receiver-emitter 25 which may be located for example in a timepiece case. Antenna 21 is connected to a micro receiver-emitter 25 by a transmission line 31 such as a coaxial cable or a micro-strip line having an excitation conductor and a mass conductor. The antenna is excited by a way of a signal applied to central line 27. To this effect, the excitation conductor of transmission line 31 is connected to an excitation point 28 which is situated on central line 27. The mass conductor and conducting element 22 are connected to the mass, for example via a connection point, non referenced, on edge 22*b*. In the example represented, each of the two extremities of this edge 22*b* are connected to the mass.

Thanks to central line 27, the excitation is integrated in the antenna and is in the same plane as the antenna. This central line serves at the same time as a "balun", i.e. this central line allows a direct connection with the micro receiver-emitter without requiring an adaptation element such as an adapting capacity. It is thus the central line 27 which realises the transition between the asymmetric output 29 of the antenna circuit and the antenna 21. Indeed, this structure according to the invention may be compared to a coaxial cable which also has a central line (the conductor) surrounded by an element connected to the mass. This structure allows to obtain an antenna which has a very good gain/bandwidth ratio with respect to prior art antennas.

Indeed, the present applicant has noticed that by varying distance δ, it is possible to modify the adaptation of the antenna 21. Thus, by changing the distance δ, it is possible to obtain the correct adaptation of the antenna to the output 29 of the antenna circuit. The value of this distance thus corresponds to the value of an adaptation capacity of a prior art antenna.

As an example, the antenna may be used to function around 1.9 Ghz. For this frequency, the following approximate dimensions apply:

the total length of conducting element 22, i.e. of a long edge 22*a*, 22*b* is around 45 mm, its width is around 2 mm, the length of the slot is around 36.4 mm, and its width is around 4 mm, the distance s is around 0.27 mm, the width d of the line 27 is around 12 mm, and the distance δ is about 0.1 mm.

Of course, these dimensions depend on the frequency and may be modified accordingly.

It may thus be understood that the shape of the antenna 21 allows an optimal use of the available surface, and that the miniaturisation of the antenna is possible thereby maintaining an optimal gain/size ratio. This thus allows to use this antenna, which has a structure adapted for optimising the excitation, in a portable device such as a wristwatch.

Figure 4:
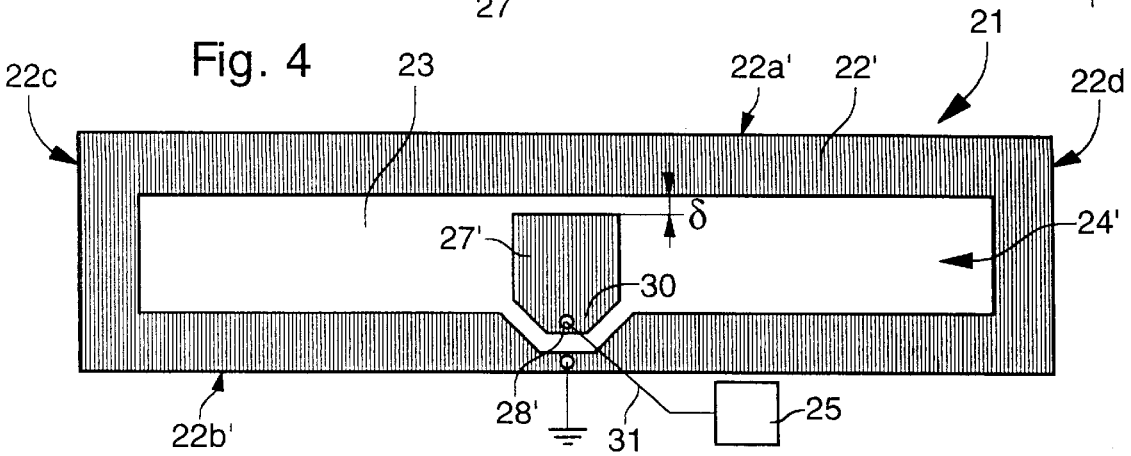
FIG. 4 shows a top view of a second embodiment of a slot antenna according to the present invention.

FIG. 4 shows a second embodiment of the antenna according to the invention. It can be seen that, with respect to the first embodiment of FIGS. 2 and 3, conducting element 22' is closed and completely surrounds slot 24'. Central line 27' is situated within lot 24' and is arranged in the same manner as in the first embodiment, i.e. this central line is situated at a distance δ from long edge 22*a*' of conducting element 22'. Central line 27' is not completely rectangular, but it has, at its side near long edge 22*b*' a projection 30 which approaches this edge 22*b*'. Long edge 22*b*' is continuous, but is has a notch for receiving at least partially projection 30 of central line 27'.

The antenna according to this second embodiment may also be directly connected via transmission line 31 to the antenna circuit comprising the micro receiver-emitter 25 without requiring discrete components.

Thanks to the antenna according to the present invention, it is possible to incorporate this antenna in a timepiece suitable to be worn on a wrist. The antenna is thus capable of receiving or emitting electromagnetic fields carrying radio diffused messages. In a known manner, the timepiece comprises organs for indicating the time, for example, hands or a digital display, and an antenna circuit comprising the micro receiver-emitter for receiving the messages picked up by the antenna.

It should be noted that several modifications and/or improvements may be applied to the antenna according to the invention thereby remaining within the scope of the present invention.

For example, it is possible to provide a screening of the antenna according to the invention, i.e. it is possible to provide a plan of mass arranged behind the substrate such as described in detail in the above-mentioned European Patent Application.

What is claimed is:

1. A slot antenna arranged to be connected to an asymmetrical output of an antenna circuit, comprising a dielectric substrate, a printed circuit conducting element attached to said substrate and defining a radiating slot having parallel edges, wherein the antenna further comprises a printed central line arranged in said slot for exciting the antenna and for serving at the same time as a balun allowing the direct connection to said output in such a manner that said central lines realises the transition between said output and the antenna, said central line being arranged at a distance δ from a first long edge of said conducting element, said distance δ being representative of the adaptation of the antenna to said output.

2. The antenna according to claim 1, wherein said substrate is of a flexible material.

3. The antenna according to claim 1, wherein said conducting element is rectangular and is discontinuous and that it comprises in a second long edge an opening which is connected to said slot.

4. The antenna according to claim 3, wherein said central line is arranged in said opening and enters said slot by approaching said conducting element, but that said central line remains removed from said first long edge of conducting element by said distance δ.

5. The antenna according to claim 1, wherein said conducting element is rectangular and is continuous and that it completely surrounds said slot.

6. The antenna according to claim 5, wherein said central line comprises a projection, and that a second long edge of said conducting element comprises a notch for receiving said projection.

7. A timepiece susceptible of being worn on a wrist, and comprising time indicating means, an antenna capable of picking up and/or emitting an electromagnetic field carrying radio transmitted message and an antenna circuit for receiving messages picked up by the antenna wherein said antenna is a slot antenna according to claim 1.

* * * * *